US007043423B2

(12) United States Patent
Vinton et al.

(10) Patent No.: US 7,043,423 B2
(45) Date of Patent: May 9, 2006

(54) LOW BIT-RATE AUDIO CODING SYSTEMS AND METHODS THAT USE EXPANDING QUANTIZERS WITH ARITHMETIC CODING

(75) Inventors: Mark Stuart Vinton, San Francisco, CA (US); Michael Mead Truman, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 821 days.

(21) Appl. No.: 10/198,638

(22) Filed: Jul. 16, 2002

(65) Prior Publication Data

US 2004/0015349 A1 Jan. 22, 2004

(51) Int. Cl.
*G10L 19/02* (2006.01)

(52) U.S. Cl. ..... 704/205; 704/206

(58) Field of Classification Search ..... None
See application file for complete search history.

(56) References Cited

U.S. PATENT DOCUMENTS

| | | | | |
|---|---|---|---|---|
| 3,684,838 A | | 8/1972 | Kahn | |
| 4,272,648 A | * | 6/1981 | Agrawal et al. | 381/108 |
| 4,273,970 A | * | 6/1981 | Favin et al. | 324/76.12 |
| 4,703,480 A | * | 10/1987 | Westall et al. | 704/212 |
| 4,935,963 A | * | 6/1990 | Jain | 704/207 |
| 4,949,383 A | * | 8/1990 | Koh et al. | 704/229 |
| 5,054,075 A | | 10/1991 | Hong et al. | |
| 5,109,417 A | * | 4/1992 | Fielder et al. | 704/205 |
| 5,127,021 A | * | 6/1992 | Schreiber | 375/130 |
| 5,394,508 A | | 2/1995 | Lim | |

FOREIGN PATENT DOCUMENTS

| | | |
|---|---|---|
| DE | 10010849 | 6/2001 |
| EP | 0645769 | 3/1995 |

OTHER PUBLICATIONS

Bell, Cleary and Witten, "Text Compression," Prentice Hall, Englewood Cliffs, NJ, 1990, pp. 109-120.
Bosi, et al., "ISO/IEC MPEG-2 Advanced Audio Coding," J. Audio Eng. Soc., vol. 45, No. 10, Oct. 1997, pp. 789-814.
Brandenburg, K., "MP3 and AAC Explained," AES 17th International Conference, Aug., 1999; pp. 99-110.
Haykin, S., "Digital Communications," John Wiley & Sons, NY, NY, 1988, pp. 193-200.
Sayood, K., "Introduction to Data Compression," Morgan Kaufmann Publishers, San Francisco, CA, 1996, pp. 61-96.

(Continued)

*Primary Examiner*—David D. Knepper
(74) *Attorney, Agent, or Firm*—David N. Lathrop, Esq.

(57) ABSTRACT

The perceived quality of an audio signals obtained from very low bit-rate audio coding system is improved by using expanding quantizers and arithmetic coding in a transmitter and using complementary compression and arithmetic decoding in a receiver. An expanding quantizer is used to control the number of signal components that are quantized to zero and arithmetic coding is used to efficiently code the quantized-to-zero coefficients. This allows a wider bandwidth and more accurately quantized baseband signal to be conveyed to the receiver, which regenerates an output signal by synthesizing the missing components.

60 Claims, 6 Drawing Sheets

OTHER PUBLICATIONS

Witten, Ian, et al,.Arithmetic Coding for Data Compression, Communications of the Association for Computing Machinery, Association for Computing Machinery New York, U.S. vol. 30, No. 6, Jun. 1, 1987, pp. 520-523.

* cited by examiner

LOW BIT-RATE AUDIO CODING SYSTEMS AND METHODS THAT USE EXPANDING QUANTIZERS WITH ARITHMETIC CODING

TECHNICAL FIELD

The present invention is related generally to digital audio coding systems and methods, and is related more specifically to improving the perceived quality of the audio signals obtained from very low bit-rate audio coding systems and methods.

BACKGROUND ART

Audio coding systems are used to encode an audio signal into an encoded signal that is suitable for transmission or storage, and then subsequently receive or retrieve the encoded signal and decode it to obtain a version of the original audio signal for playback. Perceptual audio coding systems attempt to encode an audio signal into an encoded signal that has lower information capacity requirements than the original audio signal, and then subsequently decode the encoded signal to provide an output that is perceptually indistinguishable from the original audio signal. One example of a perceptual audio coding technique is described in Bosi et al., "ISO/IEC MPEG-2 Advanced Audio Coding." J. AES, vol. 45, no. 10, October 1997, pp. 789–814, which is referred to as Advanced Audio Coding (AAC).

Perceptual coding techniques like AAC apply an analysis filterbank to an audio signal to obtain digital signal components that typically have a high level of accuracy on the order of 16–24 bits and are arranged in frequency subbands. The subband widths typically vary and are usually commensurate with widths of the so called critical bands of the human auditory system. The information capacity requirements of the signal are reduced by quantizing the subband-signal components to a much lower level of accuracy. In addition, the quantized components may also be encoded by an entropy coding process such as Huffman coding. Quantization injects noise into the quantized signals, but perceptual audio coding systems use psychoacoustic models in an attempt to control the amplitude of quantization noise so that it is masked or rendered inaudible by spectral components in the signal. An inexact replica of the subband signal components is obtained from the encoded signal by complementary entropy decoding and dequantization.

The goal in many conventional perceptual coding systems is to quantize the subband signal components and apply an entropy coding process to the quantized signal components in a manner that is optimum or as near optimum as is practical. Both quantization and entropy coding are usually designed to operate with as much mathematical efficiency as possible.

The design of an optimum or nearly optimum quantizer depends on statistical characteristics of the signal component values to be quantized. In a perceptual coding system that uses a transform to implement the analysis filterbank, the signal component values are derived from frequency-domain transform coefficients that are grouped into frequency subbands and then normalized or scaled relative to the largest magnitude component in each subband. One example of scaling is a process known as block companding. The number of the coefficients that are grouped into each subband typically increases with subband frequency so that the subband widths approximate the critical bandwidths of the human auditory system. Psychoacoustic models and bit allocation processes determine the amount of scaling for each subband signal. Grouping and scaling alter the statistical characteristics of the signal component values to be quantized; therefore, quantization efficiency is generally optimized for the characteristics of the grouped and scaled signal components.

In typical perceptual coding systems like the AAC system mentioned above, the wider subbands tend to have a few dominant subband-signal components with a relatively large magnitude and many more lesser signal components with significantly smaller magnitudes. A uniform quantizer does not quantize such a distribution of values with high efficiency. Quantizer efficiency can be improved by quantizing the smaller signal components with greater accuracy and by quantizing the larger signal components with less accuracy. This is often accomplished by using a compressing quantizer such as a μ-law or A-law quantizer. A compressing quantizer may be implemented by a compressor followed by a uniform quantizer, or it can be implemented by a non-uniform quantizer that is equivalent to the two-step process. An expanding dequantizer is used to reverse the effects of the compressing quantizer. An expanding dequantizer provides an expansion that is essentially the inverse of the compression provided in the compressing quantizer.

A compressing quantizer generally provides beneficial results in perceptual audio coding systems that represent all signal components with a level of quantization accuracy that is substantially equal to or greater than the accuracy specified by a psychoacoustic model as being necessary to mask quantization noise. Compression generally improves quantizing efficiency by redistributing the signal component values more uniformly within the input range of the quantizer.

Very low bit-rate (VLBR) audio coding systems generally cannot represent all signal components with sufficient quantization accuracy to mask the quantization noise. Some VLBR coding systems attempt to playback an output signal having a high level of perceived quality by transmitting or recording a baseband signal having only a portion of the input signal's bandwidth, and regenerating missing portions of the signal bandwidth during playback by copying spectral components from the baseband signal. This technique is sometimes referred to as "spectral translation" or "spectral regeneration". The inventors have observed that compressing quantizers generally do not provide beneficial results when used in VLBR coding systems such as those that use spectral regeneration.

The design of an optimum or nearly optimum encoder such as those used in typical audio coding systems depends on statistical characteristics of the values to be encoded. In typical systems, groups of quantized signal components are encoded by a Huffman coding process that uses one or more code books to generate variable-length codes representing the quantized signal components. The shortest codes are used to represent those quantized values that are expected to occur most frequently. Each code is expressed by an integer number of bits.

Huffman coding often provides good results in audio coding systems that can represent all signal components with sufficient quantization accuracy to mask the quantization noise. The inventors have observed, however, that Huffman coding has serious limitations that make it unsuitable for use in many VLBR coding systems. These limitations are explained below.

DISCLOSURE OF INVENTION

It is an object of the present invention to provide for improved audio coding systems and methods that overcome the disadvantages of typical audio coding that uses compressing quantizers and entropy coding like Huffman coding.

According to one aspect of the present invention, an audio encoding transmitter includes an analysis filterbank that generates a plurality of subband signals representing frequency subbands of an audio signal having subband-signal components, a quantizer coupled to the analysis filterbank that quantizes subband-signal components of one or more of the subband signals using a first quantizing accuracy for subband-signal component values within a first interval of values and using a second quantizing accuracy for subband-signal component values within a second interval of values, where the first quantizing accuracy is lower than the second quantizing accuracy, the first interval is adjacent to the second interval, and values within the first interval are smaller than values within the second interval, an encoder coupled to the quantizer that encodes the quantized subband signal components into encoded subband signals using a lossless encoding process; and a formatter coupled to the encoder that assembles the encoded subband signals into an output signal.

According to another aspect of the present invention, an audio decoding receiver includes a deformatter that obtains one or more encoded subband signals from an input signal, a decoder coupled to the deformatter that generates one or more decoded subband signals by decoding encoded subband signals using a lossless decoding process, a dequantizer coupled to the decoder that dequantizes the subband-signal components, where the dequantizer is complementary to a quantizer that uses a first quantizing accuracy for values within a first interval of values and uses a second quantizing accuracy for values within a second interval of values, where the first quantizing accuracy is lower than the second quantizing accuracy, the first interval is adjacent to the second interval, and values within the first interval are smaller than values within the second interval, and a synthesis filterbank coupled to the dequantizer that generates an output signal in response to the one or more dequantized subband signals.

According to yet another aspect of the present invention, an audio encoding transmitter includes an analysis filterbank that generates a plurality of subband signals representing frequency subbands of an audio signal having subband-signal components, a quantizer coupled to the analysis filterbank that quantizes one or more of the subband signals to generate quantized subband signals for a subband signal having one or more second subband-signal components with magnitudes less than one or more first subband-signal components by pushing the second subband-signal components into a range of values such that the second subband-signal values are quantized into fewer quantizing levels than would occur without pushing, thereby decreasing quantizing accuracy and reducing entropy of the quantized second subband-signal components, an encoder coupled to the quantizer that encodes the one or more quantized subband signals using an entropy encoding process, and a formatter coupled to the encoder that assembles encoded subband signals into an output signal.

According to a further aspect of the present invention, an audio decoding receiver includes a deformatter that obtains one or more encoded subband signals from an input signal, a decoder coupled to the deformatter that generates one or more decoded subband signals by decoding encoded subband signals using an entropy decoding process, a dequantizer coupled to the decoder that dequantizes subband-signal components of the decoded subband signals, where the dequantizer is complementary to a quantizer that, for a subband signal having one or more first subband-signal components and one or more second subband-signal components with magnitudes less than the one or more first subband-signal components, pushes the second subband-signal components into a range of values to quantize them into fewer quantizing levels than would occur without pushing, thereby decreasing quantizing accuracy and reducing entropy of the quantized second subband-signal components, and a synthesis filterbank coupled to the dequantizer that generates an output signal in response to the one or more dequantized subband signals.

The various features of the present invention and its preferred embodiments may be better understood by referring to the following discussion and the accompanying drawings. The contents of the following discussion and the drawings are set forth as examples only and should not be understood to represent limitations upon the scope of the present invention.

MODES FOR CARRYING OUT THE INVENTION

A. Transmitter

1. Overview

Figure 1:
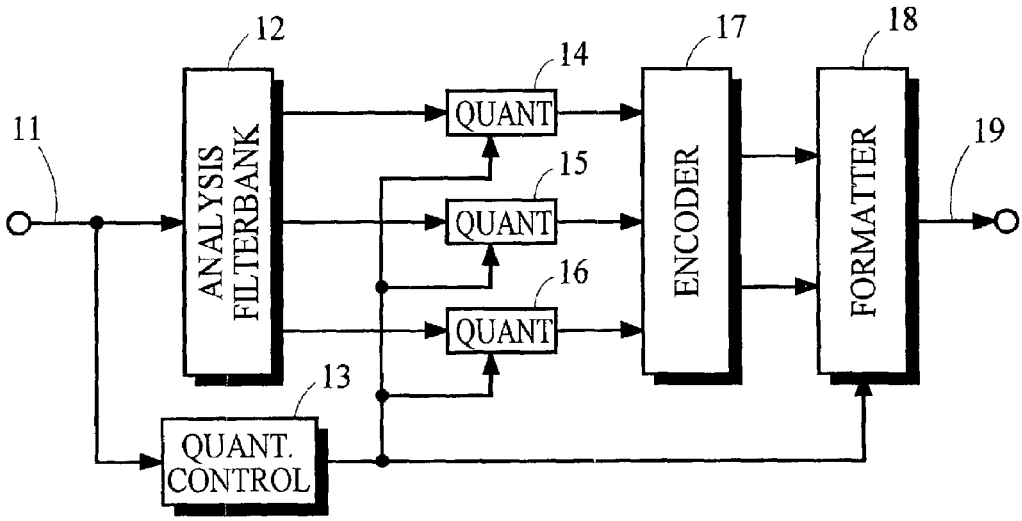
FIG. 1 is a schematic block diagram of an audio encoding transmitter.

FIG. 1 illustrates one implementation of an audio encoding transmitter that can incorporate various aspects of the present invention. In this implementation, analysis filterbank 12 receives from the path 11 audio information representing an audio signal and, in response, provides digital information that represents frequency subbands of the audio signal. The digital information in each of the frequency subbands is quantized by a respective quantizer 14, 15, 16 and passed to the encoder 17. The encoder 17 generates an encoded representation of the quantized information, which is passed to the formatter 18. In one implementation, the quantization functions in quantizers 14, 15, 16 are adapted in response to quantizing control information received from the quantizer controller 13, which generates the quantizing control information in response to the audio information received from the path 11. The formatter 18 assembles the encoded representation of the quantized information and the quantizing control information into an output signal suitable for transmission or storage, and passes the output signal along the path 19.

The transmitter illustrated in FIG. 1 shows components for three frequency subbands. Many more subbands are used in a typical application but only three are shown for illustrative clarity. No particular number is important in principle to the present invention.

The analysis filterbank 12 may be implemented in essentially any way that may be desired including a wide range of digital filter technologies, block transforms and wavelet transforms. For example, the analysis filterbank 12 may be implemented by one or more Quadrature Mirror Filters (QMF) in cascade, various discrete Fourier-type transforms such as the Discrete Cosine Transform (DCT), or a particular modified DCT known as a Time-Domain Aliasing Cancellation (TDAC) transform, which is described in Princen et al., "Subband/Transform Coding Using Filter Bank Designs Based on Time Domain Aliasing Cancellation," *ICASSP* 1987 *Conf. Proc.*, May 1987, pp. 2161–64.

Analysis filterbanks that are implemented by block transforms convert a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group.

Analysis filterbanks that are implemented by some type of digital filter such as a polyphase filter, rather than a block transform, split an input signal into a set of subband signals. Each subband signal is a time-based representation of the spectral content of the input signal within a particular frequency subband. Preferably, the subband signal is decimated so that each subband signal has a bandwidth that is commensurate with the number of samples in the subband signal for a unit interval of time.

In this discussion, the term "subband signal" refers to groups of one or more adjacent transform coefficients and the term "subband-signal components" refers to the transform coefficients. Principles of the present invention may be applied to other types of implementations, however, so the term "subband signal" generally may be understood to refer also to a time-based signal representing spectral content of a particular frequency subband of a signal, and the term "subband-signal components" generally may be understood to refer to samples of a time-based subband signal.

The quantizers 14, 15, 16 and the encoder 17 are discussed in more detail below.

The quantizer controller 13 may perform essentially any type processing that may be desired. One example is a process that applies a psychoacoustic model to audio information to estimate the psychoacoustic masking effects of different spectral components in the audio signal. Many variations are possible. For example, the quantizer controller 13 may generate the quantizing control information in response to the frequency subband information available at the output of the analysis filterbank 12 instead of, or in addition to, the audio information available at the input of the filterbank. As another example, the quantizer controller 13 may be eliminated and quantizers 14, 15, 16 use quantization functions that are not adapted. No particular process is required by the present invention.

The formatter 18 assembles the quantized and encoded signal components into a form that is suitable for passing along the path 19 for transmission or storage. The formatted signal may include synchronization patterns, error detection/correction information, and control information as desired.

2. Quantizers a) Compressing Quantizers

The quantizers 14, 15, 16 in many typical audio coding systems are compressing quantizers because compression improves quantizing efficiency. The reason for this improvement in efficiency is explained in the following paragraphs.

Figure 3:
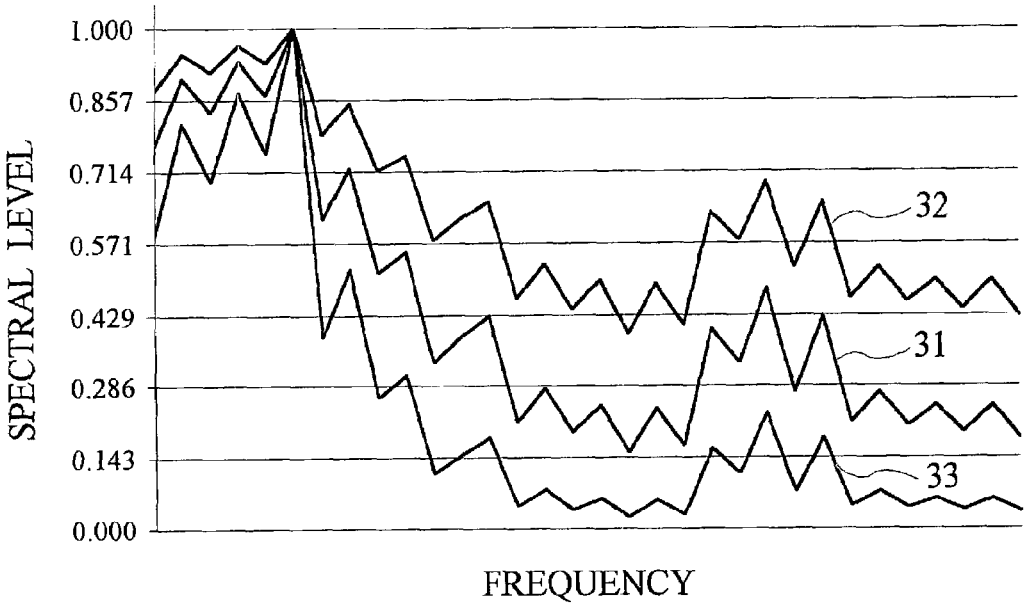
FIG. 3 is a graphical illustration of compression and expansion of hypothetical subband-signal components.

Line 31 in FIG. 3 represents component values of a hypothetical subband signal. Straight line segments connect adjacent values for illustrative clarity. Only positive values are illustrated in this figure as well as in other figures; however, the principles discussed here apply to implementations that have positive and negative component values. The component values are normalized or scaled relative to the value of the largest component in the subband signal. Eight quantization levels span the normalized range of values from zero to one.

Figure 4A:
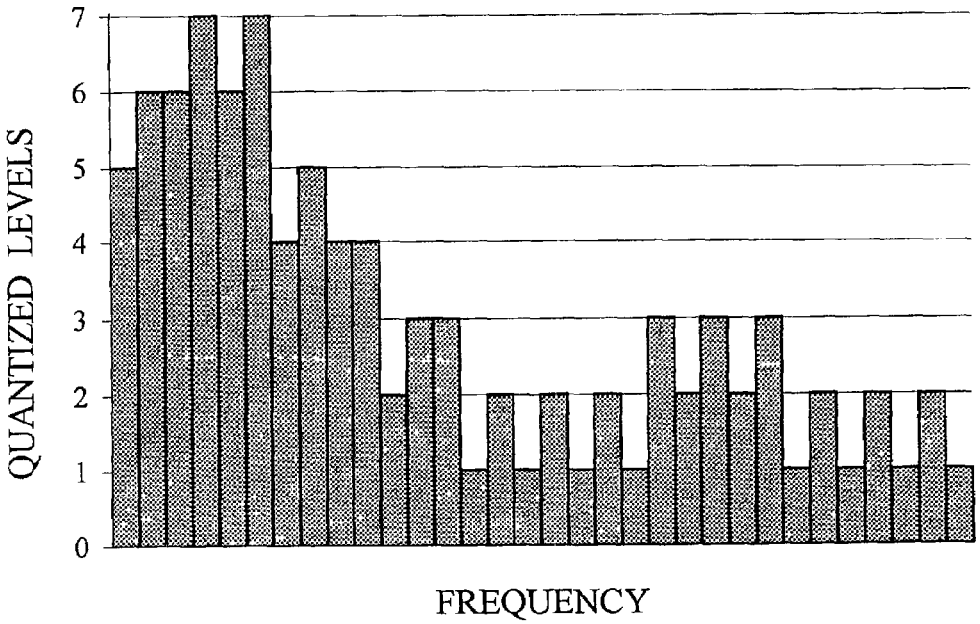
FIGS. 4A–4C are graphical illustrations of the quantization of the subband-signal components shown in FIG. 3.
Figure 7:
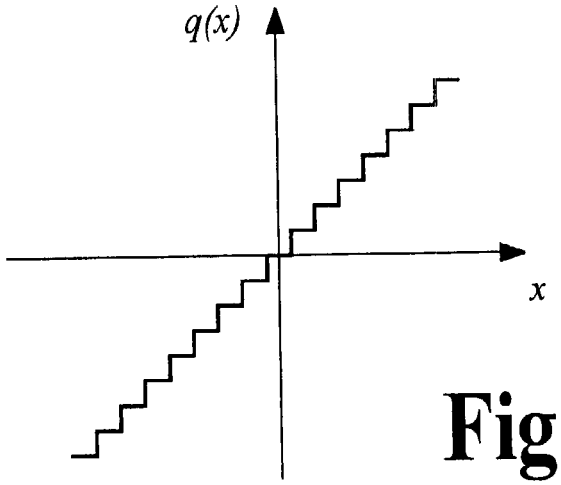
FIG. 7 is a graphical illustration of a uniform quantization function.

FIG. 4A is a graphical illustration of an eight-level quantization of the subband-signal components in line 31 using a uniform quantization function such as the function shown in FIG. 7, which rounds the signal component values to the nearest quantization level. The positive quantization levels may be represented by a 3-bit binary number. The component values that are quantized to levels below the "4" level are quantized inefficiently because these quantization levels could be represented by only two bits. In effect, one bit is wasted for each signal component that is quantized below the "4" level.

Figure 4B:
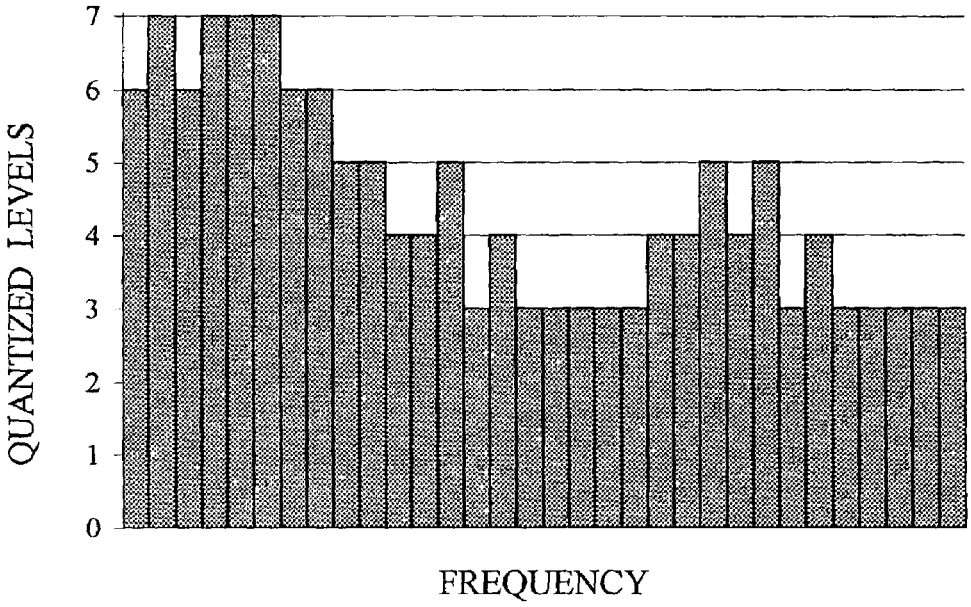
Figure 5:
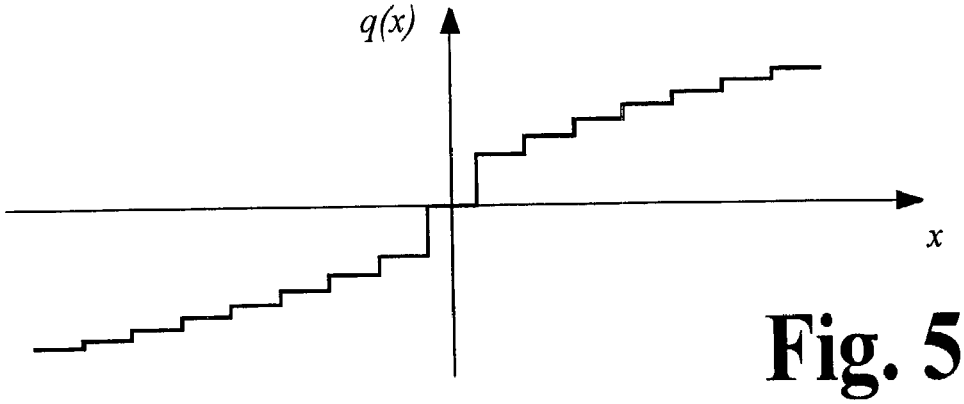
FIG. 5 is a graphical illustration of a compressing quantization function.

FIG. 4B is a graphical illustration of an eight-level quantization of the subband-signal components in line 31 using the compressing quantization function shown in FIG. 5, which rounds the signal component values to the nearest quantization level. The compressing quantizer has a higher quantizing efficiency than the uniform quantizer because fewer signal components are quantized below the "4" level. A compressing quantizer can be implemented by a non-uniform quantization function such as that shown in FIG. 5, or it can be implemented by a compression function, such as the function shown in FIG. 6, followed by a uniform quantizer shown in FIG. 7. Line 32 in FIG. 3 represents the signal values of line 31 after compression by the function shown in FIG. 6.

The quantization accuracy of a compressing quantizer is not uniform for all input values. The quantizing accuracy for an interval of small-magnitude values is higher than the quantizing accuracy for an adjacent interval of larger-magnitude values.

Compression changes the statistical distribution of the subband-signal samples by reducing the dynamic range of the values. Compression combined with normalization or scaling increases the accuracy of many smaller values by pushing these values into higher quantization levels that effectively use more bits. Expansion and an inverse scaling process are used in a receiver to reverse the effects created by scaling and compression.

Figure 6:
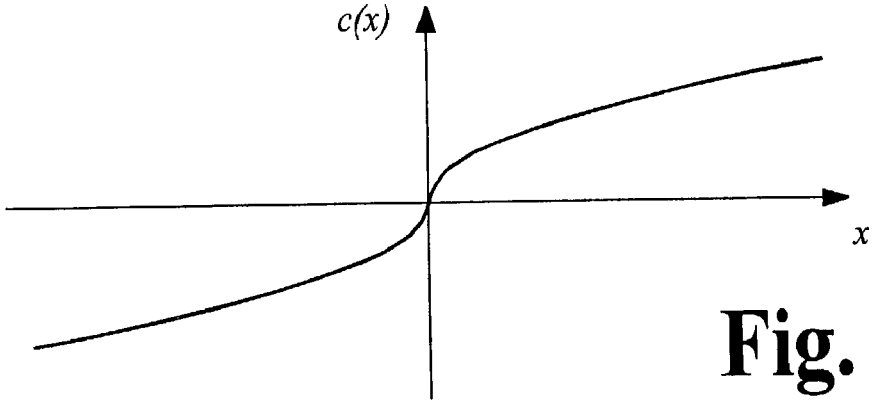
FIG. 6 is a graphical illustration of a compression function.

The compression function shown in FIG. 6 is a power-law functions of the form $$y=C(x)=x^n \tag{1a}$$

where c(x)=the compression function of x;

y=the compressed value; and n=is a positive real value less than one.

Figure 8:
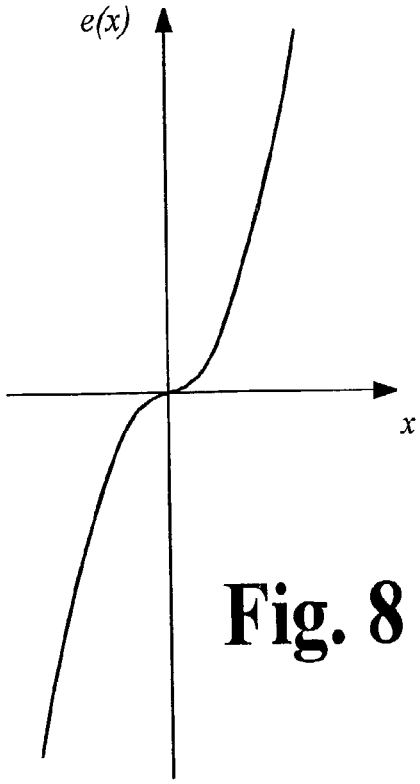
FIG. 8 is a graphical illustration of an expansion function.

A complementary expansion function is shown in FIG. 8 and is of the form $$x=e(y)=y^{1/n} \tag{1b}$$

where e(y)=the expansion function of y.

Another example of compression and expansion functions are those functions of the form $$y=c(x)=\log_b(x) \tag{2a}$$

$$x=e(y)=b^y \tag{2b}$$

Many forms of compression and expansion functions are used in traditional coding systems and essentially any form may be used in coding systems that incorporate aspects of the present invention.

b) Very Low Bit-Rate Systems

Some applications like streaming audio on public computer networks require encoded digital audio streams at bit rates that are so low that all major signal components cannot be quantized with enough accuracy to ensure quantization noise is masked.

Many attempts to provide very low bit-rate (VLBR) coding systems have attempted to provide good sounding audio by encoding and transmitting a baseband signal representing only a portion of the bandwidth of an input signal, and using techniques to regenerate the missing portions of the bandwidth during playback. Typically, high-frequency components are excluded from the baseband signal and regenerated during playback. This technique takes bits that might have been used to encode high-frequency components and uses these bits to increase the quantizing accuracy of the lower-frequency components.

This baseband/regeneration technique has not provided satisfactory results. Many efforts to improve the quality of this type of VLBR coding system have attempted to improve the regeneration technique; however, the inventors have determined that known spectral regeneration techniques do not work very well because bits are not optimally allocated to spectral components for at least two reasons.

The first reason is that the baseband signal is too narrow. This has the effect of taking bits away from all signal components outside the baseband signal, including important large-magnitude components, to encode the signal components within the baseband, including unimportant low-magnitude components. The inventors have determined that the baseband signal should have a bandwidth of about 5 kHz or more. Unfortunately, in many VLBR applications, bit-rate limitations are so severe that only about one bit can be transmitted for each spectral component of a signal with a 5 kHz bandwidth. Because one bit per spectral coefficient is not enough to allow playback of a high quality output signal, known coding systems reduce the bandwidth of the baseband signal well below 5 kHz so that the remaining signal components in the narrower baseband signal can be quantized with higher accuracy.

The second reason is that too many bits are allocated to signal components in the baseband signal that have a small magnitude. This has the effect of taking bits away from important large-magnitude components to encode unimportant low-magnitude components more accurately. This problem is aggravated by coding systems that use scaling and compressing quantizers because, as explained above, scaling and compression push small component values into larger quantizing levels.

Problems caused by each of these reasons can be alleviated by pushing the less-important small-valued signal components into a range of values that are quantized into a fewer number of quantizing levels. This process decreases the quantizing accuracy of the small-valued components but it also reduces the entropy of the small-valued signal components after quantization to a level that is less than the entropy without pushing. All signal components are entropy coded into a code that represents the less-important small-valued signal components with fewer bits than would be possible without pushing them into fewer quantizing levels, and the remaining bits are used to quantize other signal components more accurately. The number of signal components that are pushed into fewer quantizing levels can be controlled by using an expanding quantizer.

c) Expanding Quantizers

Figure 4C:
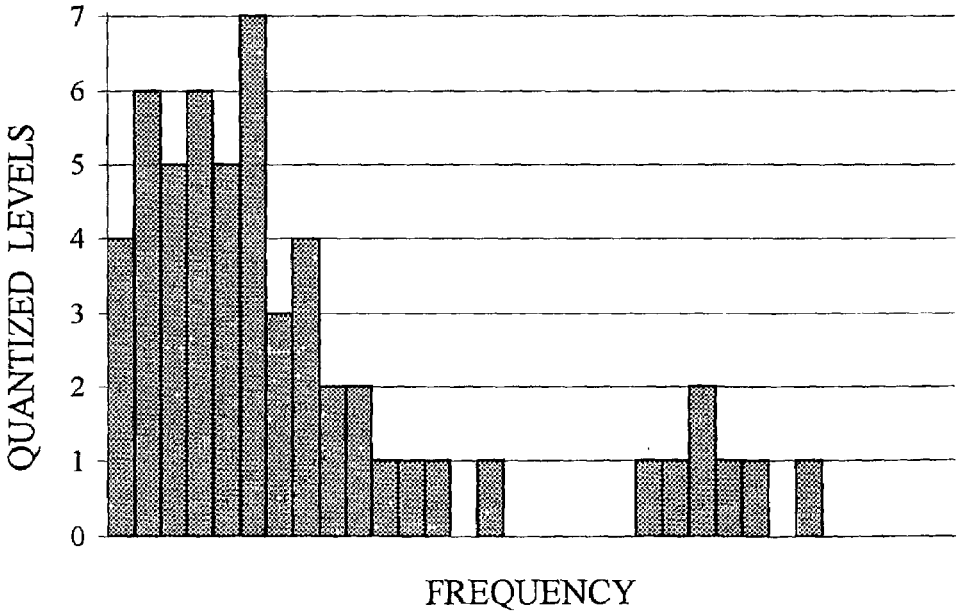
Figure 9:
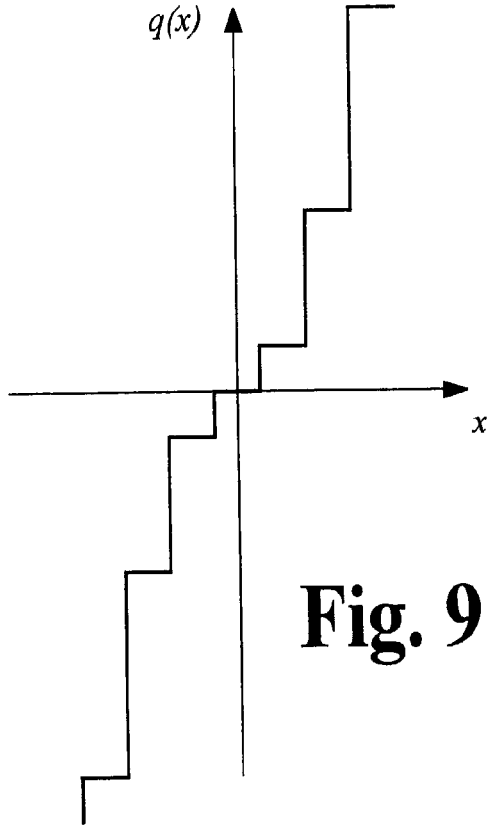
FIG. 9 is a graphical illustration of an expanding quantization function.

FIG. 4C is a graphical illustration of an eight-level quantization of the subband-signal components in line 31 using the expanding quantization function shown in FIG. 9, which rounds the signal component values to the nearest quantization level. The expanding quantizer has a lower quantizing efficiency than the uniform quantizer because more signal components are quantized below the "4" level. An expanding quantizer can be implemented by a non-uniform quantization function as shown in FIG. 9, or it can be implemented by an expansion function, such as the function shown in FIG. 8, followed by a uniform quantizer shown in FIG. 7. Line 33 in FIG. 3 represents the signal values of line 31 after expansion by the function shown in FIG. 8.

The quantization accuracy of an expanding quantizer is not uniform for all input values. The quantizing accuracy for an interval of small-magnitude values is lower than the quantizing accuracy for an adjacent interval of larger-magnitude values.

Compression and an inverse scaling process are used in a receiver to reverse the effects created by scaling and expansion.

Expansion changes the statistical distribution of the subband-signal samples by increasing the dynamic range of the values. Expansion combined with normalization or scaling decreases the accuracy of many smaller values by pushing these values into lower quantization levels. A greater number of smaller-valued signal components are pushed into the "0" quantization level, for example. By increasing the number of signal components that are quantized to low quantizing levels including "quantized-to-zero" (QTZ) signal components, and by using a code that represents these smaller and QTZ components efficiently, more bits are available to quantize larger-valued signal components more accurately.

In effect, expansion and quantization are used to identify important signal components across a wider bandwidth for more accurate encoding. This optimizes the allocation of bits so that a higher quality signal can be regenerated from a VLBR encoded signal.

Figure 10:
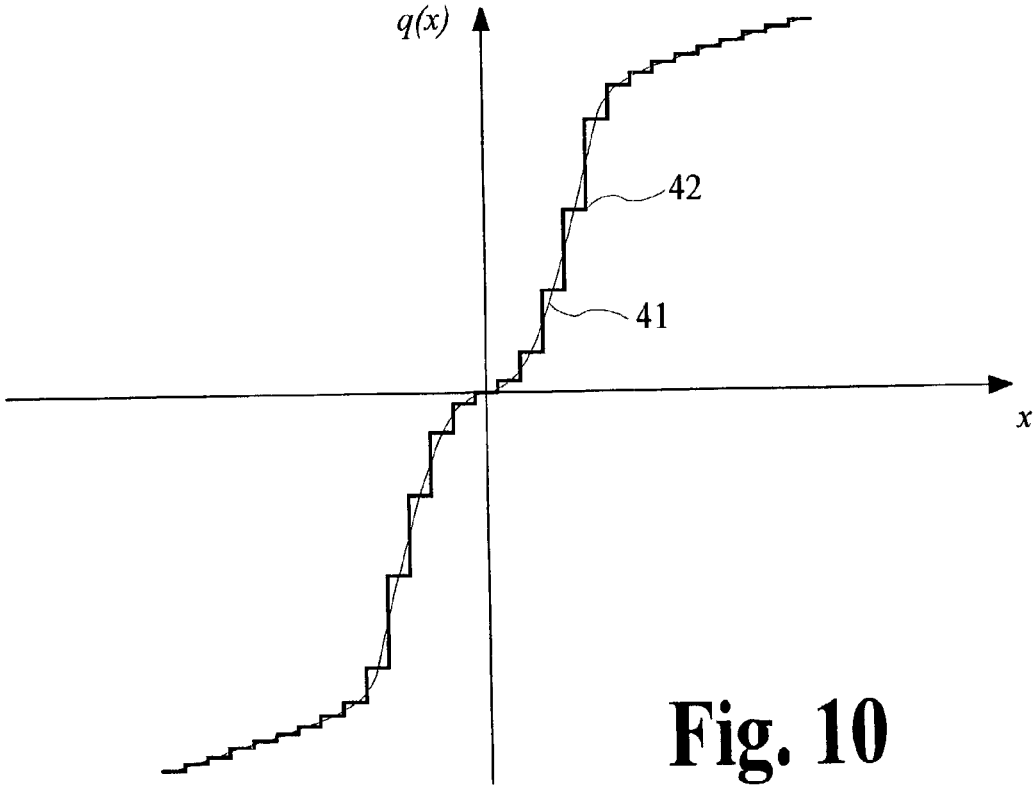
FIG. 10 is a graphical illustration of an expanding/compressing quantization function.

The quantizers may provide expansion for only part of the entire range of values to be quantized. Expansion is important for smaller values. If desired, the quantizers may also provide compression for some signal components such as those having larger values. FIG. 10 illustrates a quantization function 42 that provides expansion and compression according to function 41. Expansion is provided for values having the smallest magnitudes, and compression is provided for values having the largest magnitudes. Neither expansion nor compression is provided for values having intermediate magnitudes.

The amount of expansion and compression, if any, may be adapted in response to any or all of a variety of conditions including signal characteristics, the number of bits that are available to encode the quantized signal components, and the proximity to dominant large-magnitude components. For example, more expansion is generally needed for noise-like subband signals that have a relatively flat spectrum. Less expansion is needed if a relatively large number of bits is available for encoding. Less expansion should be used for signal components that are near dominant large-magnitude signal components. An indication of how expansion and compression is adapted should be provided in some manner to the receiver so it can adapt its complementary processes.

The quantizers 14, 15, 16 may each apply the same or different expansion functions and quantizing functions. Furthermore, the quantizer for a particular subband signal may be adapted or varied in a manner that is independent of, or at least different from, what is done in quantizers for other subband signals. In addition, expansion need not be provided for all subband signals.

3. Encoder

The encoder 17 applies entropy coding to the quantized signal components to reduce information capacity requirements. Huffman coding is used in many known coding systems but it is not well suited for use in many VLBR systems for at least two reasons.

The first reason arises from the fact that Huffman codes are composed of an integer number of bits and the shortest code is one bit in length. Huffman coding uses the shortest code for the quantized symbol having the highest probability of occurrence. It is reasonable to assume the most probable quantized value to encode is zero because the present invention tends to increase the number of QTZ signal components in subband signals. The present invention can significantly improve the signal quality in VLBR systems if QTZ components can be represented by codes that are less than one bit in length.

Shorter effective code lengths can be obtained by using Huffman coding with multi-dimensional code books. This allows Huffman coding to use a one-bit code to represent multiple quantized values. A two-dimensional code book, for example, allows a one-bit code to represent two values. Unfortunately, multi-dimensional coding is not very efficient for most subband signals and a considerable amount of memory is required to store the code book. Huffman coding can adaptively switch between single- and multi-dimensional code books, but control bits are required in the encoded signal to identify which code book is used to code parts of the signal. These control bits offset gains achieved by using multi-dimensional code books.

The second reason that Huffman coding is not suitable in many VLBR coding systems is because coding efficiency is very sensitive to the statistics of the signal to code. If a code book is used that is designed to code values having very different statistics than the signal values actually being coded, Huffman coding can impose a penalty by increasing the information capacity requirements of the encoded signal. This problem can be alleviated by selecting the best code book from a set of code books but control bits are required to identify the code book that is used. These control bits offset gains achieved by using multiple code books.

Various coding techniques such as run-length codes may be used alone or in conjunction with other forms of coding. In a preferred implementation, however, arithmetic coding is used because it can be automatically adapted to actual signal statistics and it is capable of generating shorter codes than is often possible with Huffman coding.

An arithmetic coding process calculates a real number within the half-closed interval [0, 1) to represent a "message" of one or more "symbols." In this context, a symbol is the quantized value of a signal component and the message is a set of quantizing levels for a plurality of signal components. An "alphabet" is the set of all possible symbols or quantized values that can occur in a message. The number of symbols in the message that can be represented by the real number is limited by the precision of the real number that can be expressed by the coder. The number of symbols represented by the real number code is provided to the decoder in some manner.

If M represents the number of symbols in the alphabet, then the steps in one arithmetic coding process are as follows:

1. Divide the interval [0,1) into M segments, where each segment corresponds to a particular symbol in the alphabet. The segment for a respective symbol has a length that is proportional to the probability of occurrence for that symbol.
2. Obtain the first symbol from the message and choose the corresponding segment.
3. Divide the chosen segment into M segments in a manner similar to that done in step (1). Each segment corresponds to a respective symbol in the alphabet and has a length that is proportional to the probability of occurrence for that symbol.
4. Obtain the next symbol from the message and choose the corresponding segment.
5. Continue with steps (3) and (4) until the entire message is encoded or until the limit of precision has been reached.
6. Generate the shortest possible binary fraction that represents any number within the last chosen segment.

Figure 11:
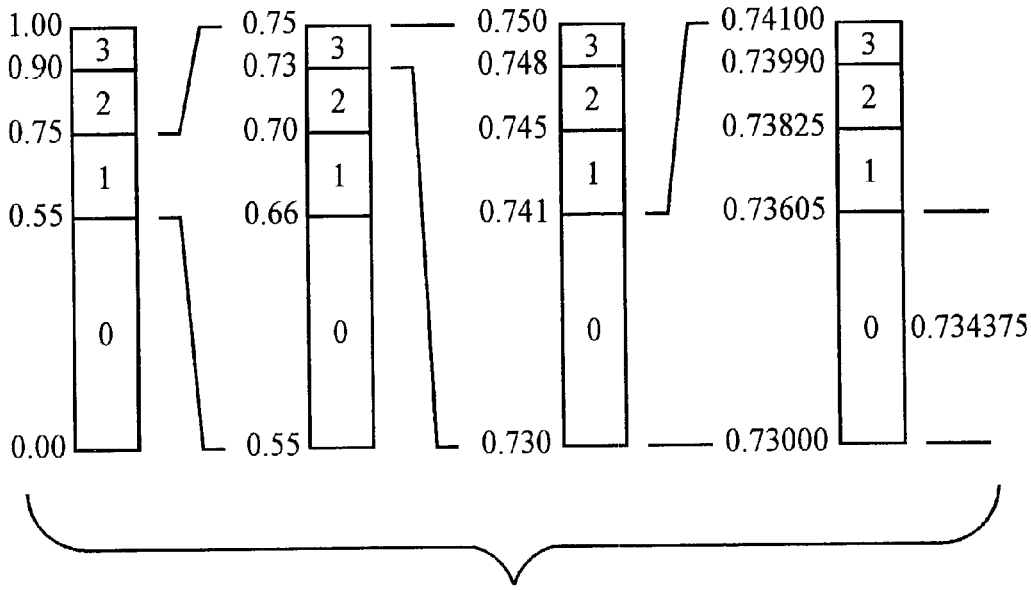
FIG. 11 is a graphical illustration of arithmetic coding.

FIG. 11 illustrates this process as applied to a message of four symbols "1300" within an alphabet of four symbols that represent four quantizing levels 0, 1, 2 and 3. The probabilities of occurrence for each of these symbols is 0.55, 0.20, 0.15 and 0.10, respectively.

The first box on the left-hand side of the figure represents step (1) in which the half-closed interval [0, 1) is divided into four segments for each symbol of the alphabet having a length proportional to the probability of occurrence for the corresponding symbols.

In step (2), the first symbol representing the "1" quantizing level is obtained from the subband-signal message and the corresponding half-closed segment [0.55, 0.75) is chosen.

The second box just to the right of the first box represents step (3) in which the chosen segment is divided into four segments for each symbol in the alphabet.

In step (4), the second symbol representing the "3" quantizing level is obtained from the message and the corresponding half-closed segment [0.73, 0.75) is chosen.

Step (5) reiterates steps (3) and (4). The third box just to the right of the second box represents a reiteration of step (3) in which the previously chosen segment is divided into four segments for each symbol in the alphabet.

In a reiteration of step (4), the third symbol representing the "0" quantizing level is obtained from the message and the corresponding half-closed segment [0.730, 0.741) is chosen.

Step (5) reiterates steps (3) and (4) again. The fourth box on the right-hand side of the drawing represents a reiteration of step (3) in which the previously chosen segment is divided into four segments for each symbol in the alphabet.

In a reiteration of step (4), the fourth and last symbol representing the "0" quantizing level is obtained from the message and the corresponding half-closed segment [0.73000, 0.73605) is chosen.

Having reached the end of the message, step (6) generates the shortest possible binary fraction that represents some number within the last chosen segment. A 6-bit binary fraction $0.101111_2=0.734375_{10}$ is generated.

The coding process described above requires a probability distribution for the symbol alphabet, and this distribution must be provided to the decoder in some manner. If the probability distribution changes, the coding process become suboptimal. The encoder 17 can calculate a new distribution from the actual probability of the symbols received for coding. This calculation can be done continually as each symbol is obtained from the message, or it can be calculated less frequently. The decoder 23 can perform the same calculations and keep its distribution synchronized with the encoder 17. The coding process can begin with any desired probability distribution.

Additional information about arithmetic coding may be obtained from Bell, Cleary and Witten., "Text Compression," Prentice Hall, Englewood Cliffs, N.J., 1990, pp. 109–120, and from Saywood, "Introduction to Data Compression," Morgan Kaufmann Publishers, Inc., San Francisco, 1996, pp. 61–96.

B. Receiver

Figure 2:
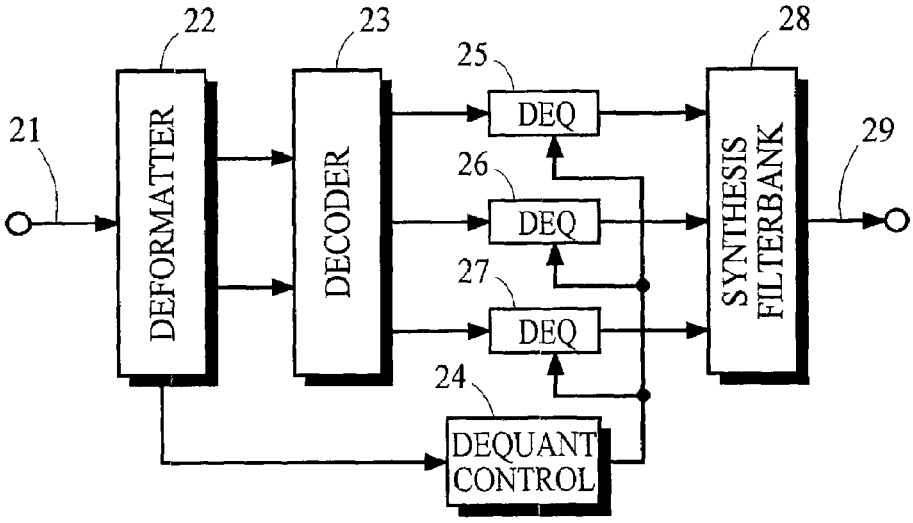
FIG. 2 is a schematic block diagram of an audio decoding receiver.

FIG. 2 illustrates one implementation of an audio decoding receiver that can incorporate various aspects of the present invention. In this implementation, deformatter 22 receives from the path 21 an input signal conveying an encoded representation of quantized digital information representing frequency subbands of an audio signal. The deformatter 22 obtains the encoded representation from the input signal and passes it to the decoder 23. The decoder 23 decodes the encoded representation into frequency subbands of quantized information. The quantized digital information in each of the frequency subbands is dequantized by a respective dequantizer 25, 26, 27 and passed to the synthesis filterbank 28, which generates along the path 29 audio information representing an audio signal. The dequantization functions in the dequantizers 25, 26 , 27 are adapted in response to dequantizing control information received from the dequantizing controller 24, which generates the dequantizing control information in response to control information obtained by the deformatter 22 from the input signal.

The decoder 23 applies a process that is complementary to the process applied by the encoder 17. In a preferred implementation, arithmetic decoding is used.

The dequantizers 25, 26, 27 provide compression that is complementary to the expansion provided in the quantizers 14, 15, 16. A compressing dequantizer may be implemented by a non-uniform dequantization function, or it may be implemented by a uniform dequantization function followed by a compression function. Non-uniform and uniform dequantization may be implemented by table-lookup. Uniform dequantization may be implemented by a process that merely appends an appropriate number of bits to the quantized value. The appended bits may all have a zero value or they may be have some other value such as samples from a dither signal or pseudo-random noise signal.

Compression should not be provided throughout the full range of values if the quantizers 14, 15, 16 did not provide expansion throughout the full range of values.

The dequantizing controller 24 may perform essentially any type of processing that may be desired. One example is a process that applies a psychoacoustic model to information obtained from the input signal to estimate the psychoacoustic masking effects of different spectral components in an audio signal. As another example, the dequantizing controller 24 is eliminated and dequantizers 25, 26, 27 may either use dequantization functions that are not adapted or they may use dequantization functions that are adapted in response to dequantizing control information obtained directly from the input signal by the deformatter 22. No particular process is required by the present invention.

The receiver illustrated in FIG. 2 shows components for three frequency subbands. Many more subbands are used in a typical application but only three are shown for illustrative clarity. No particular number is important in principle to the present invention.

The synthesis filterbank 28 may be implemented in essentially any way that may be desired including ways that are inverse to the techniques discussed above for the analysis filterbank 12. Synthesis filterbanks that are implemented by block transforms synthesize an output signal from sets of transform coefficients. Synthesis filterbanks that are implemented by some type of digital filter such as a polyphase filter, rather than a block transform, synthesize an output signal from a set of subband signals. Each subband signal is a time-based representation of the spectral content of an input signal within a particular frequency subband.

C. Implementation

Figure 12:
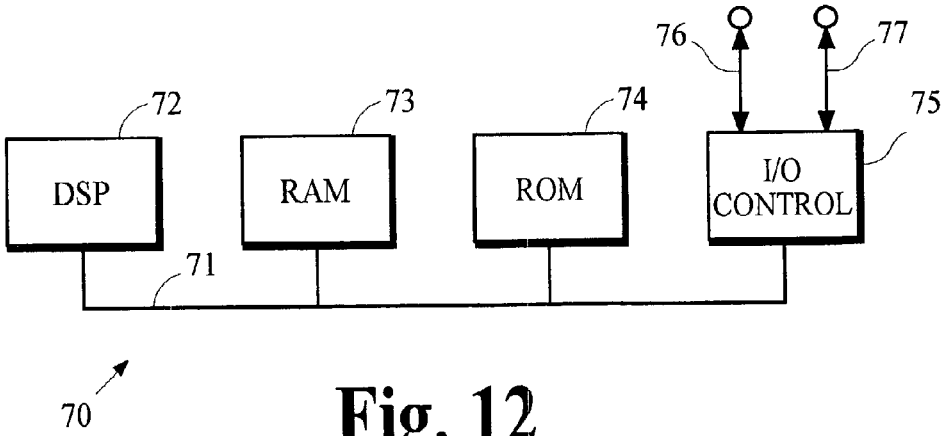
FIG. 12 is a schematic block diagram of an apparatus that may be used to implement various aspects of the present invention.

Various aspects of the present invention may be implemented in a wide variety of ways including software in a general-purpose computer system or in some other apparatus that includes more specialized components such as digital signal processor (DSP) circuitry coupled to components similar to those found in a general-purpose computer system. FIG. 12 is a block diagram of device 70 that may be used to implement various aspects of the present invention in an audio encoding transmitter or an audio decoding receiver. DSP 72 provides computing resources. RAM 73 is system random access memory (RAM) used by DSP 72 for signal processing. ROM 74 represents some form of persistent storage such as read only memory (ROM) for storing programs needed to operate device 70. I/O control 75 represents interface circuitry to receive and transmit signals by way of communication channels 76, 77. Analog-to-digital converters and digital-to-analog converters may be included in I/O control 75 as desired to receive and/or transmit analog audio signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include embodiments of programs that implement various aspects of the present invention.

The functions required to practice the present invention can also be performed by special purpose components that are implemented in a wide variety of ways including discrete logic components, one or more ASICs and/or program-controlled processors. The manner in which these components are implemented is not important to the present invention.

Software implementations of the present invention may be conveyed by a variety machine readable media such as baseband or modulated communication paths throughout the spectrum including from supersonic to ultraviolet frequencies, or storage media including those that convey information using essentially any magnetic or optical recording technology including magnetic tape, magnetic disk, and optical disc. Various aspects can also be implemented in various components of computer system 70 by processing circuitry such as ASICs, general-purpose integrated circuits, microprocessors controlled by programs embodied in various forms of ROM or RAM, and other techniques.

The invention claimed is:

1. An audio encoding transmitter that receives an input signal representing an audio signal and generates an output signal conveying an encoded representation of the audio signal, the audio encoding transmitter comprising:

an analysis filterbank that generates a plurality of subband signals representing frequency subbands of the audio signal in response to the input signal, wherein each subband signal comprises one or more subband-signal components;

a quantizer coupled to the analysis filterbank that generates one or more quantized subband signals by quantizing subband-signal components of one or more of the subband signals using a first quantizing accuracy for subband-signal component values within a first interval of values and using a second quantizing accuracy for subband-signal component values within a second interval of values, wherein the first quantizing accuracy is lower than the second quantizing accuracy, the first interval is adjacent to the second interval, and values within the first interval are smaller than values within the second interval;

an encoder coupled to the quantizer that generates one or more encoded subband signals by encoding the one or more quantized subband signals using a lossless encoding process that reduces information capacity requirements of the quantized subband signals; and a formatter coupled to the encoder that assembles the one or more encoded subband signals into the output signal.

2. The audio encoding transmitter of claim 1 wherein the analysis filterbank is implemented by one or more transforms and the subband-signal components are transform coefficients.

3. The audio encoding transmitter of claim 1 wherein the quantizer comprises:

an expander having an input coupled to the analysis filterbank and having an output; and a uniform quantizer having an input coupled to the output of the expander and having an output coupled to the encoder.

4. The audio encoding transmitter of claim 1 wherein the quantizer is a non-uniform quantizer.

5. The audio encoding transmitter of claim 1 wherein the quantizer uses a third quantizing accuracy for subband-signal component values within a third interval of values, the third quantizing accuracy is lower than the second quantizing resolution, and values within the second interval are smaller than values within the third interval.

6. The audio encoding transmitter of claim 1 wherein the encoder generates variable-length codes and the encoding process adapts to statistics of the quantized subband signals being encoded.

7. The audio encoding transmitter of claim 6 wherein the encoding process is arithmetic encoding.

8. The audio encoding transmitter of claim 1 that adapts the first quantizing accuracy relative to the second quantizing accuracy in response to characteristics of the subband-signal component values.

9. An audio decoding receiver that receives an input signal conveying an encoded representation of an audio signal and generates an output signal representing the audio signal, the audio decoding receiver comprising:

a deformatter that obtains one or more encoded subband signals from the input signal;

a decoder coupled to the deformatter that generates one or more decoded subband signals by decoding the one or more encoded subband signals using a lossless decoding process that increases information capacity requirements of the encoded subband signals, wherein each decoded subband signal comprises one or more subband-signal components and represents a respective frequency subband of the audio signal;

a dequantizer coupled to the decoder that generates one or more dequantized subband signals by dequantizing subband-signal components of the one or more decoded subband signals, wherein the dequantizer is complementary to a quantizer that uses a first quantizing accuracy for values within a first interval of values and uses a second quantizing accuracy for values within a second interval of values, wherein the first quantizing accuracy is lower than the second quantizing accuracy, the first interval is adjacent to the second interval, and values within the first interval are smaller than values within the second interval; and a synthesis filterbank coupled to the dequantizer that generates the output signal in response to a plurality of subband signals including the one or more dequantized subband signals.

10. The audio decoding receiver of claim 9 wherein the synthesis filterbank is implemented by one or more transforms and the subband-signal components are transform coefficients.

11. The audio decoding receiver of claim 9 wherein the dequantizer comprises:

a uniform dequantizer having an input coupled to the decoder and having an output; and a compressor having an input coupled to the output of the uniform dequantizer and having an output coupled to the synthesis filterbank.

12. The audio decoding receiver of claim 9 wherein the dequantizer is a non-uniform dequantizer.

13. The audio decoding receiver of claim 9 wherein the dequantizer is complementary to a quantizer that uses a third quantizing accuracy for subband-signal component values within a third interval of values, the third quantizing accuracy is is lower than the second quantizing resolution, and values within the second interval are smaller than values within the third interval.

14. The audio decoding receiver of claim 9 wherein the decoder decodes variable-length codes and the decoding process adapts to statistics of the quantized subband signals being decoded.

15. The audio decoding receiver of claim 14 wherein the decoding process is arithmetic decoding.

16. The audio decoding receiver of claim 9 that adapts the dequantizer in response to control information obtained from the input signal, wherein the dequantizer is adapted to be complementary to a quantizer that adapts the first quantizing accuracy relative to the second quantizing accuracy.

17. A medium that is readable by a device and that conveys a program of instructions executable by the device to perform an audio encoding method that comprises steps performing the acts of:

applying an analysis filterbank to the input signal to generate a plurality of subband signals representing frequency subbands of the audio signal, wherein each subband signal comprises one or more subband-signal components;

quantizing subband-signal components of one or more of the subband signals using a first quantizing accuracy for subband-signal component values within a first interval of values and using a second quantizing accuracy for subband-signal component values within a second interval of values to generate one or more quantized subband signals, wherein the first quantizing accuracy is lower than the second quantizing accuracy, the first interval is adjacent to the second interval, and values within the first interval are smaller than values within the second interval;

encoding the one or more quantized subband signals using a lossless encoding process that reduces information capacity requirements of the quantized subband signals to generate one or more encoded subband signals; and assembling the one or more encoded subband signals into the output signal.

18. The medium of claim 17 wherein the analysis filterbank is implemented by one or more transforms and the subband-signal components are transform coefficients.

19. The medium of claim 17 wherein the quantizing comprises expanding subband-signal components and quantizing the expanded subband-signal components with a uniform quantization function.

20. The medium of claim 17 wherein the quantizing is according to a non-uniform quantization function.

21. The medium of claim 17 wherein the quantizing uses a third quantizing accuracy for subband-signal component values within a third interval of values, the third quantizing accuracy is lower than the second quantizing resolution, and values within the second interval are smaller than values within the third interval.

22. The medium of claim 17 wherein the encoding generates variable-length codes and the encoding process adapts to statistics of the quantized subband signals being encoded.

23. The medium of claim 22 wherein the encoding process is arithmetic encoding.

24. The medium of claim 17 wherein the method adapts the first quantizing accuracy relative to the second quantizing accuracy in response to characteristics of the subband-signal component values.

25. A medium that is readable by a device and that conveys a program of instructions executable by the device to perform an audio decoding method that comprises steps performing the acts of:

obtaining one or more encoded subband signals from the input signal;

decoding the one or more encoded subband signals using a lossless decoding process that increases information capacity requirements of the encoded subband signals to generate one or more decoded subband signals, wherein each decoded subband signal comprises one or more subband-signal components and represents a respective frequency subband of the audio signal;

dequantizing subband-signal components of the one or more decoded subband signals to generate one or more dequantized subband signals, wherein the dequantizing is complementary to quantizing that uses a first quantizing accuracy for values within a first interval of values and uses a second quantizing accuracy for values within a second interval of values, wherein the first quantizing accuracy is lower than the second quantizing accuracy, the first interval is adjacent to the second interval, and values within the first interval are smaller than values within the second interval; and applying a synthesis filterbank to a plurality of subband signals including the one or more dequantized subband signals to generate the output signal.

26. The medium of claim 25 wherein the synthesis filterbank is implemented by one or more transforms and the subband-signal components are transform coefficients.

27. The medium of claim 25 wherein the dequantizing comprises uniformly dequantizing and compressing the subband-signal components.

28. The medium of claim 25 wherein the dequantizing is according to a non-uniform dequantization function.

29. The medium of claim 25 wherein the dequantizing is complementary to quantizing that uses a third quantizing accuracy for subband-signal component values within a third interval of values, the third quantizing accuracy is is lower than the second quantizing resolution, and values within the second interval are smaller than values within the third interval.

30. The medium of claim 25 wherein the decoding process adapts to statistics of the quantized subband signals being decoded.

31. The medium of claim 30 wherein the decoding process is arithmetic decoding.

32. The medium of claim 25 wherein the method adapts the dequantizing in response to control information obtained from the input signal, wherein the dequantizing is adapted to be complementary to quantizing that adapts the first quantizing accuracy relative to the second quantizing accuracy.

33. An audio encoding transmitter that receives an input signal representing an audio signal and generates an output signal conveying an encoded representation of the audio signal, the audio encoding transmitter comprising:

an analysis filterbank that generates a plurality of subband signals representing frequency subbands of the audio signal in response to the input signal, wherein each subband signal comprises one or more subband-signal components;

a quantizer coupled to the analysis filterbank that quantizes one or more of the subband signals to generate quantized subband signals, wherein for a subband signal having one or more first subband-signal components and one or more second subband-signal components with magnitudes less than the one or more first subband-signal components, the second subband-signal components are pushed into a range of values that are quantized into fewer quantizing levels than would occur without pushing, thereby decreasing quantizing accuracy and reducing entropy of the quantized second subband-signal components;

an encoder coupled to the quantizer that generates one or more encoded subband signals by encoding the one or more quantized subband signals using an entropy encoding process that reduces information capacity requirements of the quantized subband signals; and a formatter coupled to the encoder that assembles the one or more encoded subband signals into the output signal.

34. The audio encoding transmitter of claim 33 wherein the analysis filterbank is implemented by one or more transforms and the subband-signal components are transform coefficients.

35. The audio encoding transmitter of claim 33 wherein the quantizer comprises:

an expander having an input coupled to the analysis filterbank and having an output; and a uniform quantizer having an input coupled to the output of the expander and having an output coupled to the encoder.

36. The audio encoding transmitter of claim 33 wherein the quantizer is a non-uniform quantizer.

37. The audio encoding transmitter of claim 33 wherein the encoding process adapts to statistics of the quantized subband signals being encoded.

38. The audio encoding transmitter of claim 37 wherein the encoding process is arithmetic encoding.

39. The audio encoding transmitter of claim 33 that adapts the range of values into which the second subband-signal components are pushed in response to characteristics of the subband-signal component values.

40. An audio decoding receiver that receives an input signal conveying an encoded representation of an audio signal and generates an output signal representing the audio signal, the audio decoding receiver comprising:

a deformatter that obtains one or more encoded subband signals from the input signal;

a decoder coupled to the deformatter that generates one or more decoded subband signals by decoding the one or more encoded subband signals using an entropy decoding process that increases information capacity requirements of the encoded subband signals, wherein each decoded subband signal comprises one or more subband-signal components and represents a respective frequency subband of the audio signal;

a dequantizer coupled to the decoder that generates one or more dequantized subband signals by dequantizing subband-signal components of the one or more decoded subband signals, wherein the dequantizer is complementary to a quantizer that, for a subband signal having one or more first subband-signal components and one or more second subband-signal components with magnitudes less than the one or more first subband-signal components, pushes the second subband-signal components into a range of values to quantize them into fewer quantizing levels than would occur without pushing, thereby decreasing quantizing accuracy and reducing entropy of the quantized second subband-signal components; and a synthesis filterbank that generates the output signal in response to a plurality of subband signals including the one or more dequantized subband signals.

41. The audio decoding receiver of claim 40 wherein the synthesis filterbank is implemented by one or more transforms and the subband-signal components are transform coefficients.

42. The audio decoding receiver of claim 40 wherein the dequantizer comprises:

a uniform dequantizer having an input coupled to the decoder and having an output; and a compressor having an input coupled to the output of the uniform dequantizer and having an output coupled to the synthesis filterbank.

43. The audio decoding receiver of claim 40 wherein the dequantizer is a non-uniform dequantizer.

44. The audio decoding receiver of claim 40 wherein the decoding process adapts to statistics of the quantized subband signals being decoded.

45. The audio decoding receiver of claim 44 wherein the decoding process is arithmetic decoding.

46. The audio decoding receiver of claim 40 that adapts the dequantizer in response to control information obtained from the input signal, wherein the dequantizer is adapted to be complementary to a quantizer that adapts the range of values into which the second subband-signal components are pushed in response to characteristics of the subband-signal component values.

47. A medium that is readable by a device and that conveys a program of instructions executable by the device to perform an audio encoding method that comprises steps performing the acts of:

applying an analysis filterbank to the input signal to generate a plurality of subband signals representing frequency subbands of the audio signal, wherein each subband signal comprises one or more subband-signal components;

quantizing subband-signal components of one or more of the subband signals to generate quantized subband signals, wherein for a subband signal having one or more first subband-signal components and one or more second subband-signal components with magnitudes less than the one or more first subband-signal components, the second subband-signal components are pushed into a range of values that are quantized into fewer quantizing levels than would occur without pushing, thereby decreasing quantizing accuracy and reducing entropy of the quantized second subband-signal components;

encoding the one or more quantized subband signals using an entropy encoding process that reduces information capacity requirements of the quantized subband signals to generate one or more encoded subband signals; and assembling the one or more encoded subband signals into the output signal.

48. The medium of claim 47 wherein the analysis filterbank is implemented by one or more transforms and the subband-signal components are transform coefficients.

49. The medium of claim 47 wherein the quantizing comprises expanding subband-signal components and quantizing the expanded subband-signal components with a uniform quantization function.

50. The medium of claim 47 wherein the quantizing is according to a non-uniform quantization function.

51. The medium of claim 47 wherein the entropy encoding process adapts to statistics of the quantized subband signals being encoded.

52. The medium of claim 51 wherein the entropy encoding process is arithmetic encoding.

53. The medium of claim 47 wherein the method adapts the range of values into which the second subband-signal components are pushed in response to characteristics of the subband-signal component values.

54. A medium that is readable by a device and that conveys a program of instructions executable by the device to perform an audio decoding method that comprises steps performing the acts of:

obtaining one or more encoded subband signals from the input signal;

decoding the one or more encoded subband signals using a lossless decoding process that increases information capacity requirements of the encoded subband signals to generate one or more decoded subband signals, wherein each decoded subband signal comprises one or more subband-signal components and represents a respective frequency subband of the audio signal;

dequantizing subband-signal components of the one or more decoded subband signals to generate one or more dequantized subband signals, wherein the dequantizing is complementary to quantizing that uses a first quantizing accuracy for values within a first interval of values and uses a second quantizing accuracy for values within a second interval of values, wherein the first quantizing accuracy is lower than the second quantizing accuracy, the first interval is adjacent to the second interval, and values within the first interval are smaller than values within the second interval; and applying a synthesis filterbank to a plurality of subband signals including the one or more dequantized subband signals to generate the output signal.

55. The medium of claim 54 wherein the synthesis filterbank is implemented by one or more transforms and the subband-signal components are transform coefficients.

56. The medium of claim 54 wherein the dequantizing comprises uniformly dequantizing and compressing the subband-signal components.

57. The medium of claim 54 wherein the dequantizing is according to a non-uniform dequantization function.

58. The medium of claim 54 wherein the entropy decoding process adapts to statistics of the quantized subband signals being decoded.

59. The medium of claim 58 wherein the entropy decoding process is arithmetic decoding.

60. The medium of claim 54 wherein the method adapts the dequantizing in response to control information obtained from the input signal, wherein the dequantizing is adapted to be complementary to quantizing that adapts the range of values into which the second subband-signal components are pushed in response to characteristics of the subband-signal component values.

* * * * *